US008414367B1

(12) United States Patent
Virag et al.

(10) Patent No.: US 8,414,367 B1
(45) Date of Patent: Apr. 9, 2013

(54) WINDOW MOUNTED AIR CONDITIONER SAFETY NET

(76) Inventors: Joseph Stephen Virag, Ridgefield, CT (US); Douglas Birney Patrick, Newtown, CT (US)

( * ) Notice: Subject to any disclaimer, the term of this patent is extended or adjusted under 35 U.S.C. 154(b) by 127 days.

(21) Appl. No.: 13/019,940

(22) Filed: Feb. 2, 2011

(51) Int. Cl.

| | |
|---|---|
| ***E06B 7/02*** | (2006.01) |
| ***F24F 7/013*** | (2006.01) |
| *A47H 13/00* | (2006.01) |
| *A47H 15/00* | (2006.01) |
| *E06B 3/00* | (2006.01) |
| *E06B 9/00* | (2006.01) |
| *F25D 23/12* | (2006.01) |
| *E04G 3/00* | (2006.01) |

(52) U.S. Cl.
USPC ..... 454/204; 160/368.1; 62/262; 182/82

(58) Field of Classification Search ..... 52/202, 52/12; 49/50, 57, 463; 160/327, 368.1, 354; 182/138; 280/749; 256/12.5; 5/120; 62/262, 62/263, 331; D23/353, 354; 454/204
See application file for complete search history.

(56) References Cited

U.S. PATENT DOCUMENTS

| | | | | | |
|---|---|---|---|---|---|
| 149,126 | A | * | 3/1874 | Higgins | 160/327 |
| 612,166 | A | * | 10/1898 | Lefort | 160/327 |
| 1,374,348 | A | * | 4/1921 | Barrell | 403/60 |
| 1,461,648 | A | * | 7/1923 | Bryant | 160/352 |
| 1,635,601 | A | * | 7/1927 | Benca | 160/161 |
| 2,914,075 | A | * | 11/1959 | Wells et al. | 62/331 |
| 3,002,236 | A | * | 10/1961 | Humphner | 52/202 |
| 3,328,929 | A | * | 7/1967 | Mullins | 52/202 |
| 3,527,319 | A | * | 9/1970 | Pedley | 182/139 |
| 3,949,834 | A | * | 4/1976 | Nusbaum | 182/138 |
| 4,019,556 | A | * | 4/1977 | Selger | 160/238 |
| 4,186,468 | A | * | 2/1980 | Zaniewski | 24/483 |
| 4,227,669 | A | * | 10/1980 | McInnis | 248/317 |
| 4,498,374 | A | * | 2/1985 | Gibson | 454/204 |
| 4,520,979 | A | * | 6/1985 | McInnis | 248/323 |
| 4,986,389 | A | * | 1/1991 | Halligan, Sr. et al. | 182/138 |
| 5,429,206 | A | * | 7/1995 | Nusbaum | 182/138 |
| 5,517,949 | A | * | 5/1996 | Harris et al. | 119/795 |
| 5,787,955 | A | * | 8/1998 | Dargie | 160/368.1 |
| 5,960,586 | A | * | 10/1999 | Chen | 47/40 |
| 6,044,595 | A | * | 4/2000 | Snow | 52/101 |
| D634,413 | S | * | 3/2011 | Wallace | D23/354 |

* cited by examiner

*Primary Examiner* — Jonathan Liu
*Assistant Examiner* — Guang H Guan
(74) *Attorney, Agent, or Firm* — Michael I. Kroll

(57) ABSTRACT

A window mounted air conditioning unit safety net that protects a window mounted air conditioning unit from falling from a window opening during installation, operation and removal thereof.

11 Claims, 10 Drawing Sheets

WINDOW MOUNTED AIR CONDITIONER SAFETY NET

BACKGROUND OF THE INVENTION

1. Field of the Invention

The present invention relates generally to air conditioning units and, more specifically, to a safety net for window mounted air conditioners. The integrity of an improperly mounted air conditioner can be compromised due to the vibrations of the unit during use thereby causing the air conditioner to plummet to the ground below thus creating a potentially costly and dangerous situation. Furthermore, the risk increases exponentially during installation and removal of the air conditioning unit as it is not mounted and is awkward to handle.

The present invention seeks to overcome these shortcomings by providing a safety net that is installed prior to the installation of the air conditioner and replaceably removed upon removal of the unit. The net is manufactured of a high tensile material such as wire, cable or dense fiber and includes a plurality of cinching rings to conform to the size of the air conditioner unit.

2. Description of the Prior Art

There are other safety systems designed for window mounted air conditioning units. While these systems may be suitable for the purposes for which they were designed, they would not be as suitable for the purposes of the present invention as heretofore described.

SUMMARY OF THE PRESENT INVENTION

A primary object of the present invention is to provide a flexible safety net to prevent a window mounted air conditioning unit from inadvertently falling from the window.

Another object of the present invention is to provide a window mounted air conditioning unit safety net having an anchoring device that secures to the interior or exterior of a window structure.

Yet another object of the present invention is to provide a window mounted air conditioning unit safety net wherein the net is manufactured of high tensile material such as wire, cable or high density fiber.

Still yet another object of the present invention is to provide a window mounted air conditioning unit safety net further comprising an air conditioning fitted cable that fits snugly around the periphery of the body that optionally provides for adjustment.

An additional object of the present invention is to provide a window mounted air conditioning unit safety net having integral horizontal upper and lower support lines extending beyond the netting for securing to the anchoring device.

A further object of the present invention is to provide a window mounted air conditioning unit safety net wherein the support lines have mounting rings disposed on the distal ends thereof.

A yet further object of the present invention is to provide a window mounted air conditioning unit safety net wherein the mounting rings are removably secured to their respective anchoring devices with removable clips.

A still yet further object of the present invention is to provide a window mounted air conditioning unit safety net that is installed prior to installation of the air conditioning unit.

Another object of the present invention is to provide a window mounted air conditioning unit safety net that is removed after the air conditioning unit has been pulled from the window opening.

Additional objects of the present invention will appear as the description proceeds.

The present invention overcomes the shortcomings of the prior art by providing a window mounted air conditioning unit safety net that protects a window mounted air conditioning unit from falling from a window opening during installation, operation and removal thereof.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
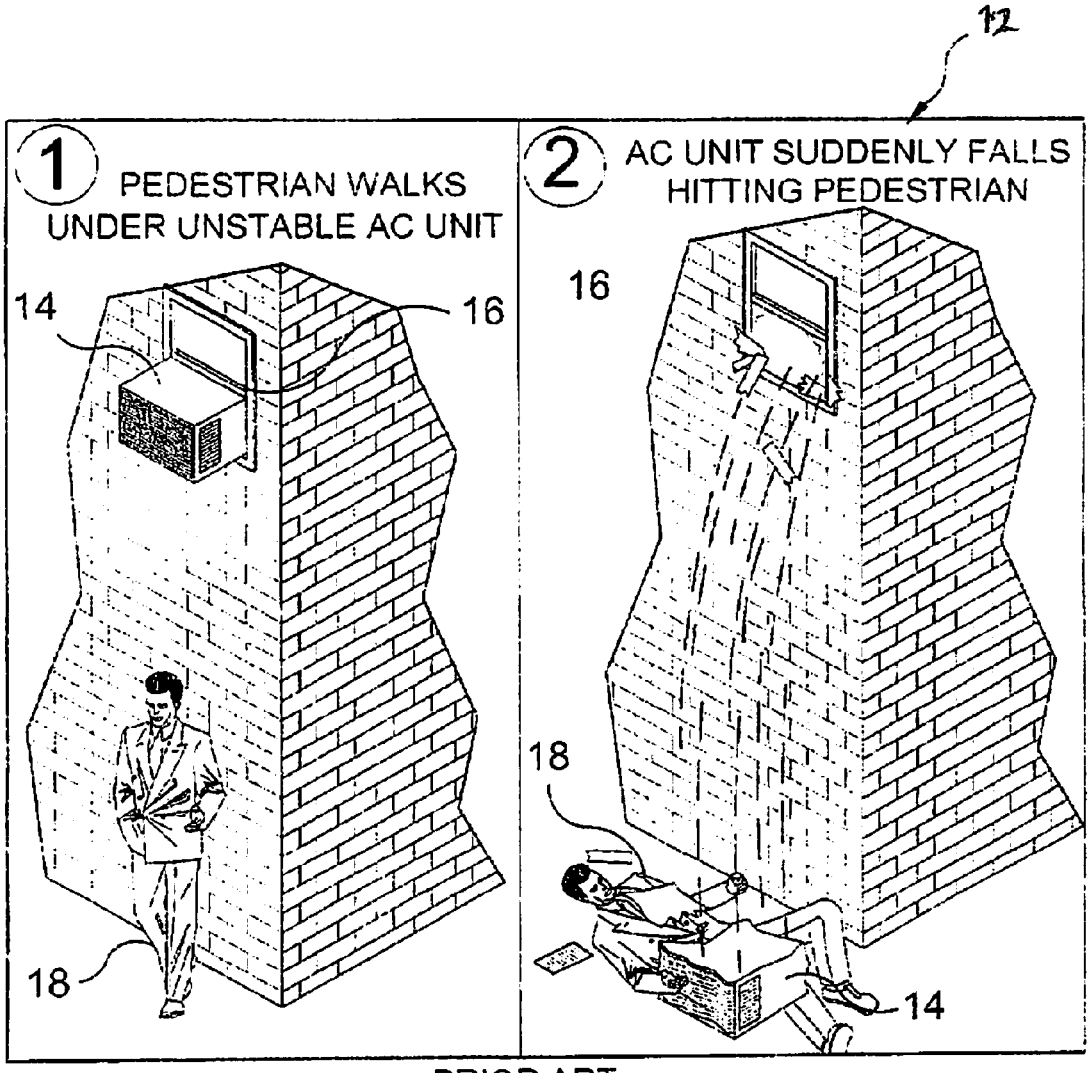
PRIOR ART FIG. 1
FIG. 1 is an illustrative view of the prior art.

Turning now descriptively to the drawing figures, in which similar reference characters denote similar elements throughout the several views, the figures illustrate the Window Mounted Air Conditioning Unit Safety Net of the present invention. With regard to the reference numerals used, the following numbering is used throughout the various drawing figures.

10 Window Mounted Air Conditioning Unit Safety Net of the present invention
12 prior art
14 window mounted air conditioning unit
16 window
18 pedestrian
20 net assembly
22 net webbing
24 support cable

26 upper support cable
28 lower support cable
30 cinching ring
32 mounting ring
34 support frame of 16
36 mounting assembly
38 structure of building
40 anchoring device
42 removable clip
44 eyelet of 40
46 fitted cable

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the prior art 12. Currently, air conditioner units 14 installed in windows 16 are at great risk of falling out of a window 16 due to poor installation or faulty mounting apparatus and risk of falling during installation and removal thereby endangering pedestrians 18 passing therebelow and costly damage to the air conditioner 14 and other material in the drop zone.

The present invention provides an air conditioning unit safety net that is installed prior to the installation of the air conditioning unit 14.

Figure 2:
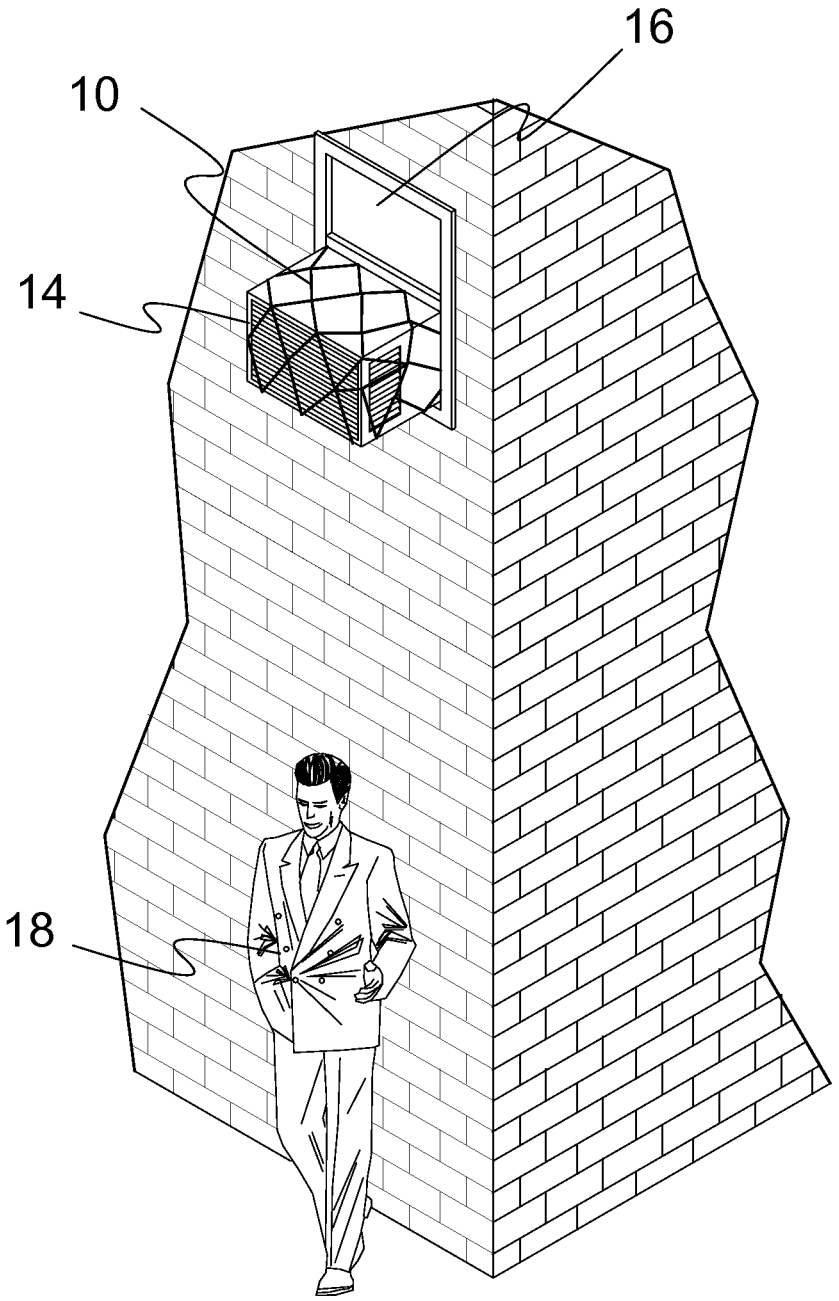
FIG. 2 is an illustrative view of the present invention in use.

Referring to FIG. 2, shown is an illustrative view of the present invention in use. The present invention is a flexible air conditioner safety net 10 that is installed prior to the installation of a window mounted air conditioner unit 14 in a window 16 to secure the AC unit and eliminate the possibility of the unit falling from the window opening to the ground and injuring a pedestrian 18 or damaging material. The safety net 10 is secured to the buildings structure, internally or externally.

Figure 3:
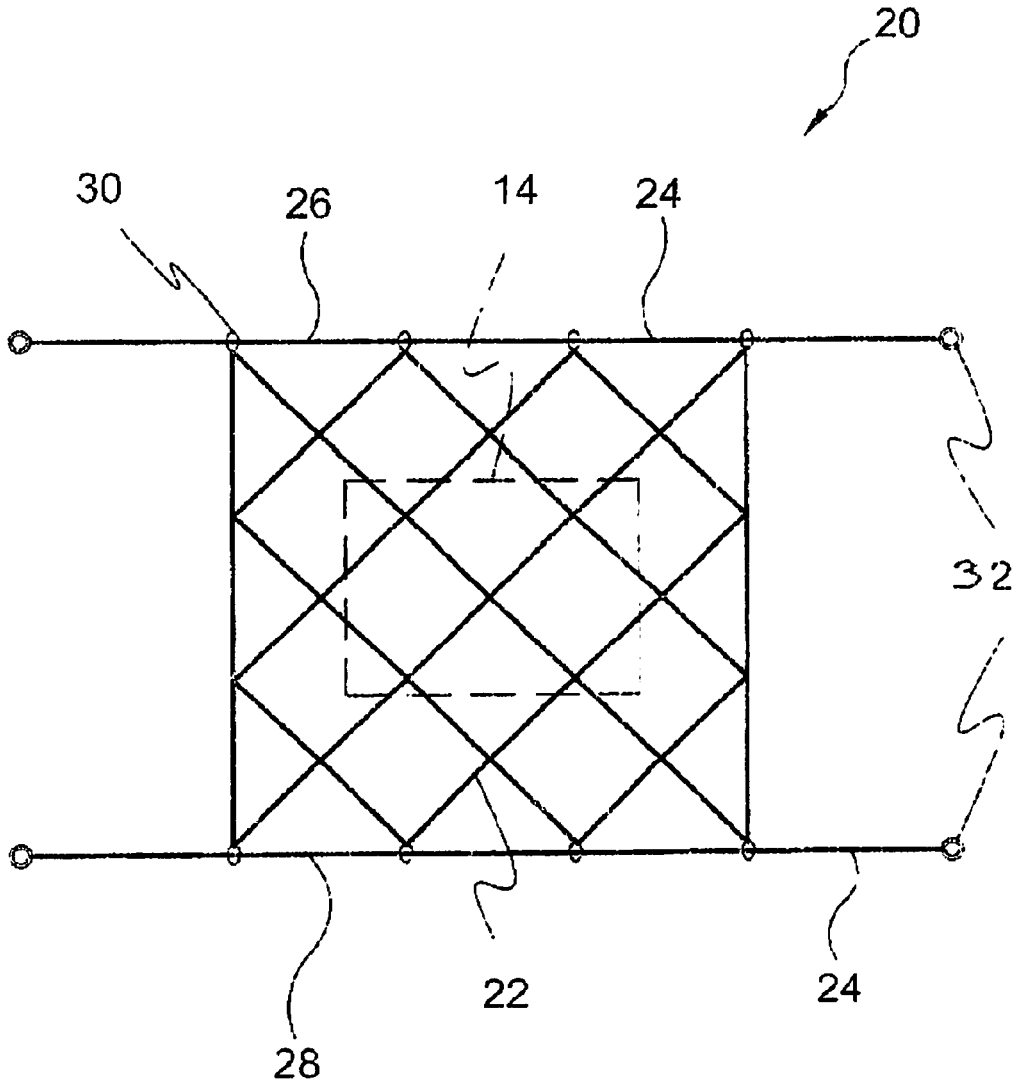
FIG. 3 is an orthographic view of the present invention.

Referring to FIG. 3, shown is an orthographic view of the present invention. Shown is the net assembly 20 of the present invention having a flexible net webbing 22 that encompasses the air conditioner unit 14 with a pair of spaced apart horizontal support cables 24 forming an upper support cable 26 and a lower support cable 28 with the net webbing 22 affixed to the support cables 24 by a plurality of cinching rings 30 that slide freely along their respective support cables 24. Mounting rings 32 are disposed on the distal ends of the support cables 24 to provide fastening means to the building structure.

Figure 4:
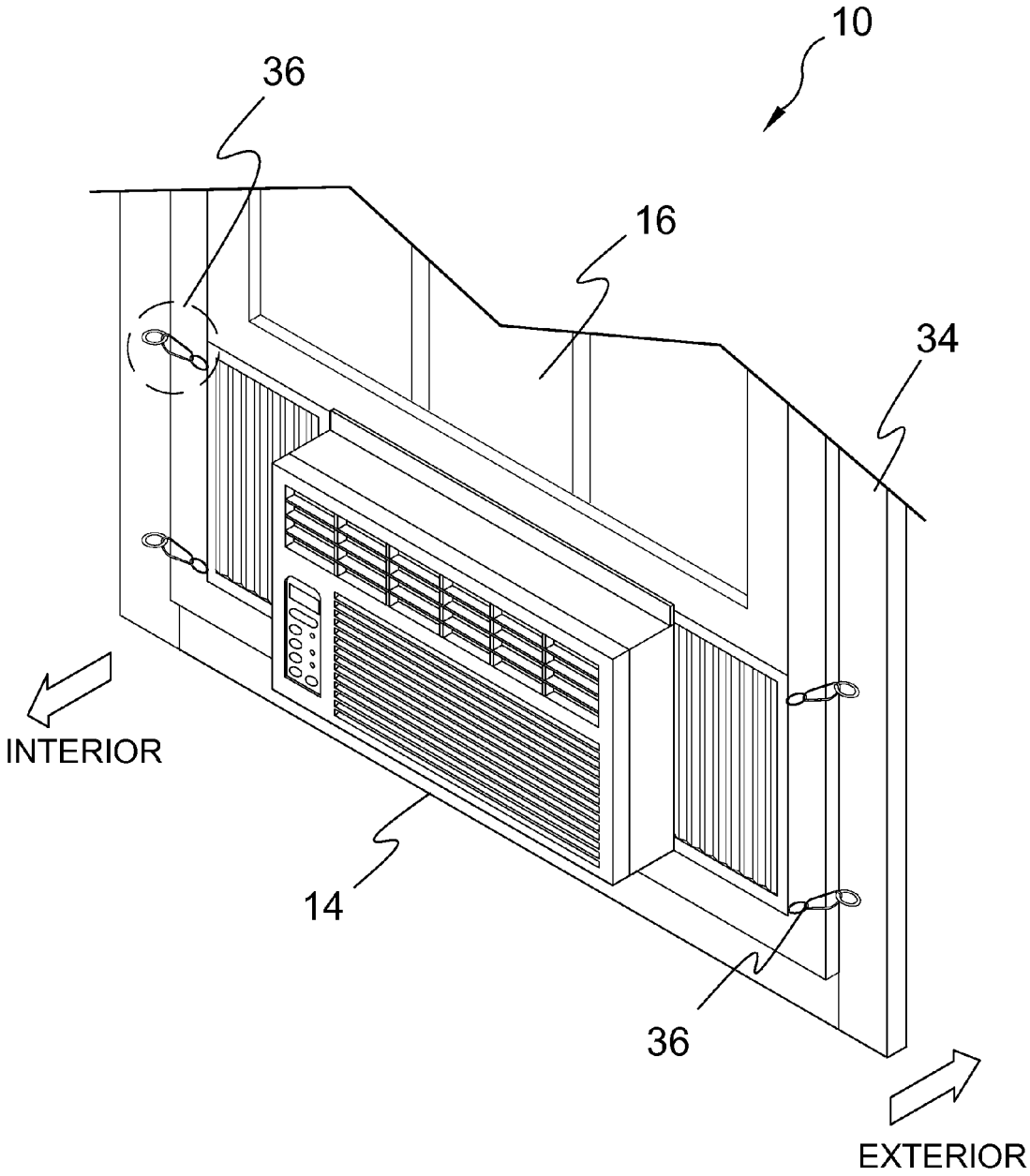
FIG. 4 is an illustrative perspective view of the present invention in use.

Referring to FIG. 4, shown is an illustrative perspective view of the window mounted air conditioner safety net 10 of the present invention in use. Shown is an indoor view of an air conditioner 14 installed in a window 16 and secured to the support frame 34 of the window 16 with a plurality of mounting assemblies 36.

Figure 5:
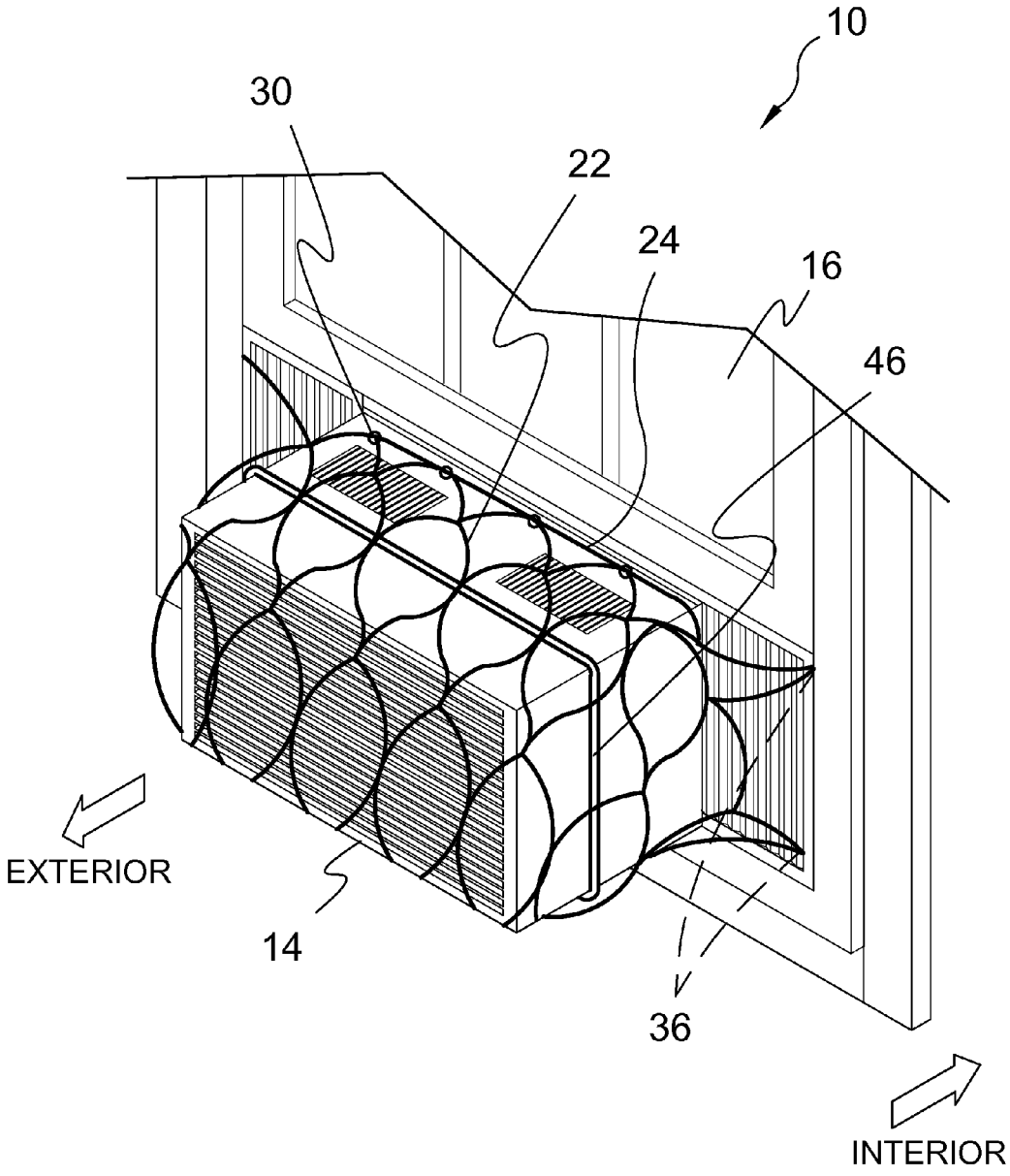
FIG. 5 is an illustrative perspective view of the present invention in use.

Referring to FIG. 5, shown is an illustrative perspective view of the present invention in use. Shown is an outdoor view of an air conditioner unit 14 having the air conditioner safety net 10 securing it to the window 16. The net webbing 22 encompasses the unit and the cinching rings 30 are appropriately gathered along the support cables 24 which lead to the mounting assemblies 36. Also shown is an optional fitted cable 46, which may be provided in the plurality to accommodate the various sizes of air conditioning units.

Figure 6:
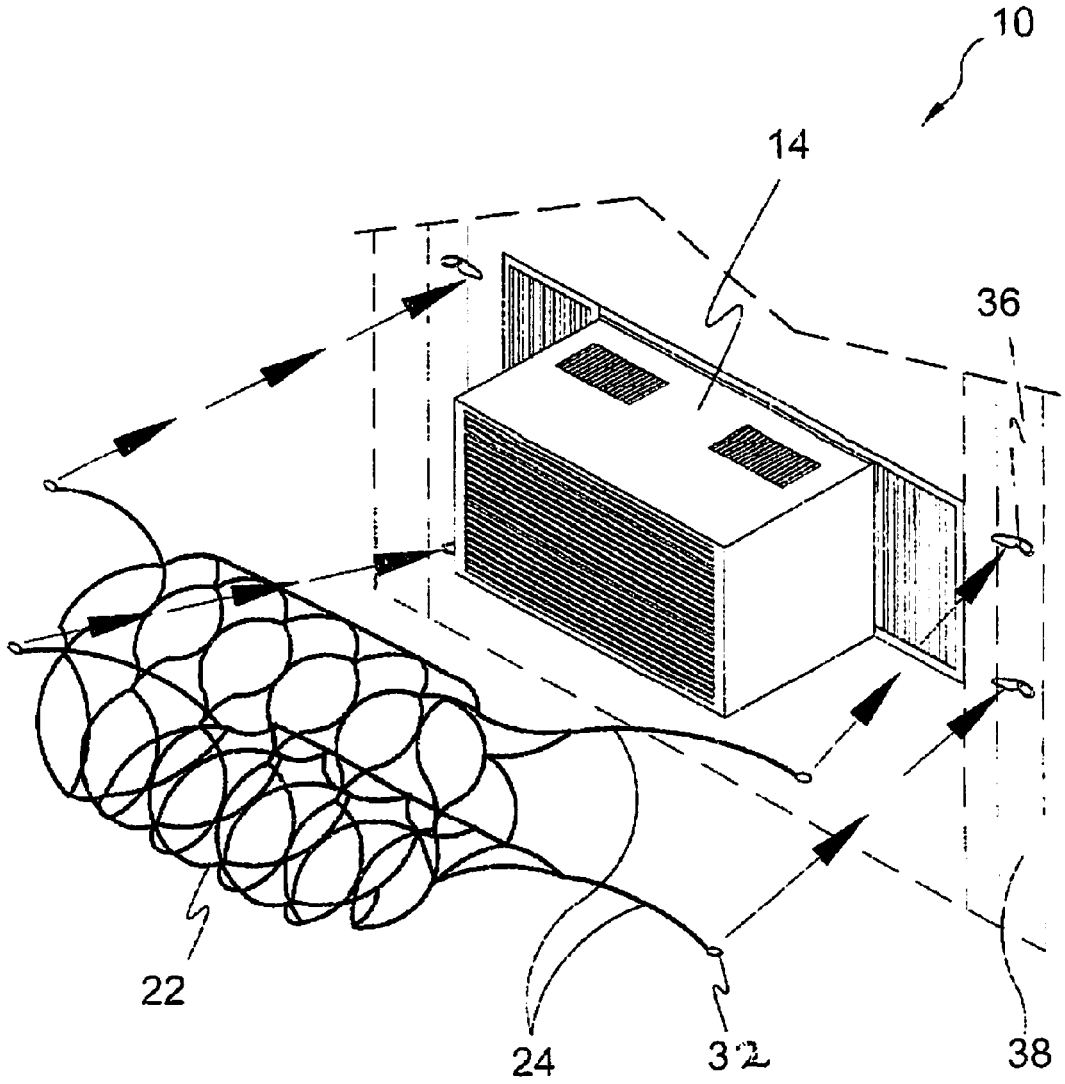
FIG. 6 is an illustrative perspective view of the present invention in use.

Referring to FIG. 6, shown is an illustrative perspective view of the present invention in use. Shown is an outdoor view of an air conditioner 14 having the air conditioner unit safety net 10 of the present invention unattached from the buildings structure 38. The safety net 10 can be secured to the building structure 38 inside or outside said building depending upon the building facade. Mounting loops 32 disposed on the distal ends of the support cables 24 are utilized for fastening the net webbing 22 to the mounting assemblies 36.

Figure 7:
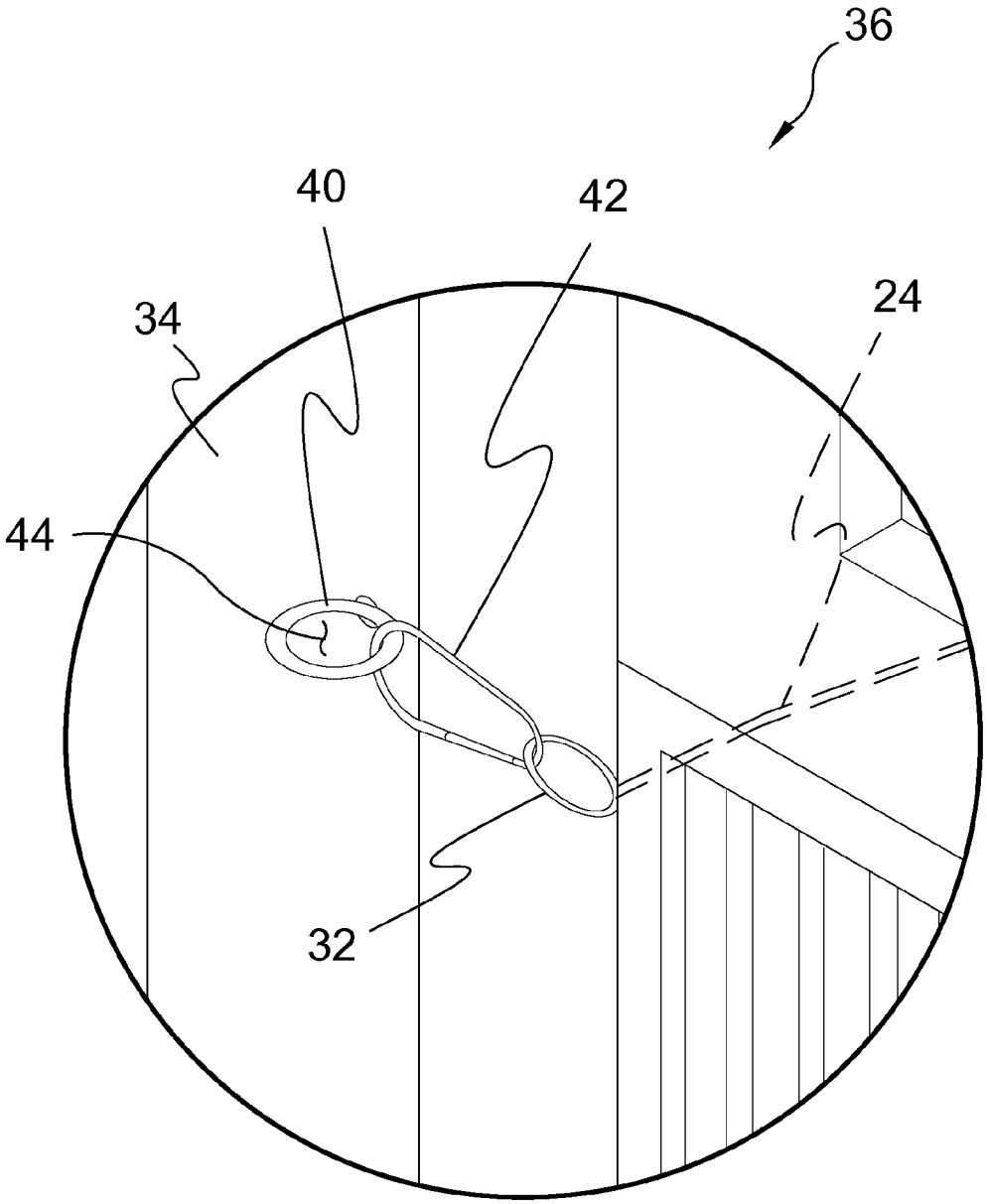
FIG. 7 is a detailed view of the safety net securing means of the present invention.

Referring to FIG. 7, shown is a detailed view of the safety net mounting assembly 36 of the present invention. Shown is a detailed view of the means of securing the safety net to a building structure using anchor devices 40 with eyelets 44 either partially inside or outside the support frame 34 supplemented for proper installation with masonry anchors or wood screws depending upon the building facade construction type. The mounting rings 32 on the support cables 24 of the safety net can be attached to the anchor devices 40 with a spring clip, carabineer or other type of removable clip 42.

Figure 8:
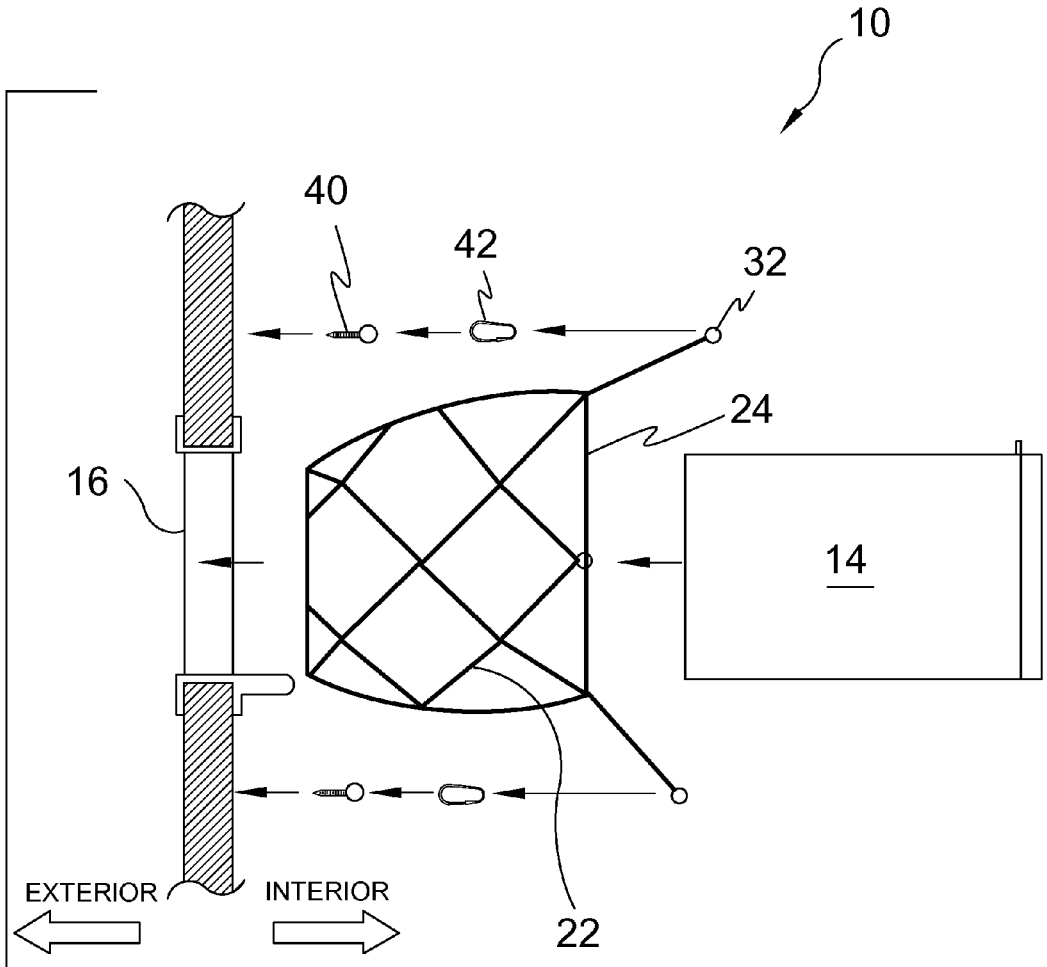
FIG. 8 is an exploded side view of the present invention.

Referring to FIG. 8, shown is an exploded side view of the window mounted air conditioner unit safety net 10 of the present invention. Shown is the net webbing 22 with support cables 24 and affiliated mounting rings 32, the anchoring device 40, removable clip 42, the air conditioning unit 14 and the window 16 in which it is to be installed.

Figure 9:
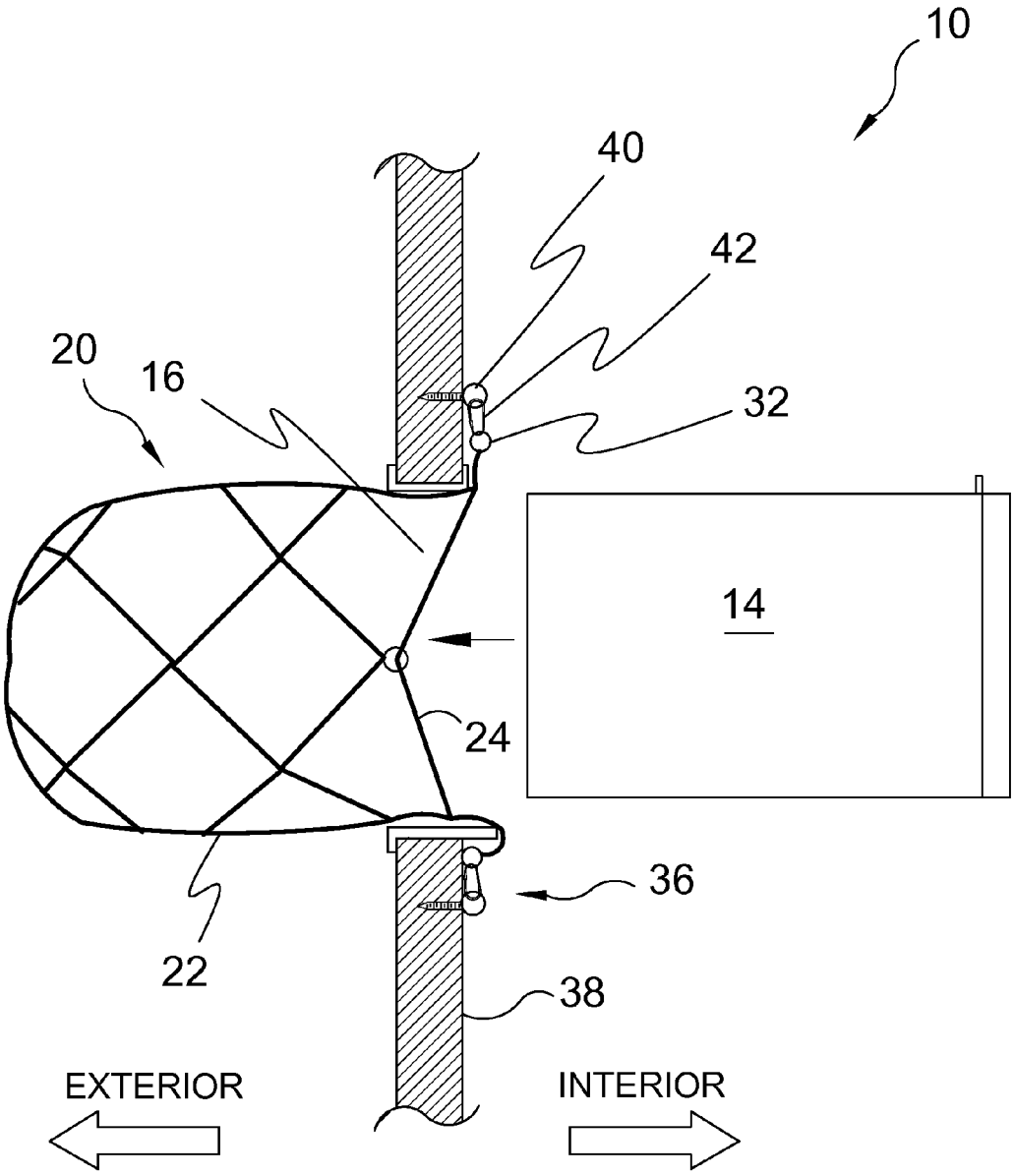
FIG. 9 is a side view of the present invention.

Referring to FIG. 9, shown is a side view of the present invention. Shown is a side view of the window mounted air conditioning unit safety net 10 of the present invention mounted internally to a window 16 of a building structure 38. Shown is the net assembly 20 comprising a net webbing 22 having support cables 24 and mounting rings 32 disposed on the distal ends thereof. Also shown are mounting assemblies 36 comprising an anchoring device 40 and removable clip 42. The air conditioning unit 14 is then inserted into the net webbing 22.

Figure 10:
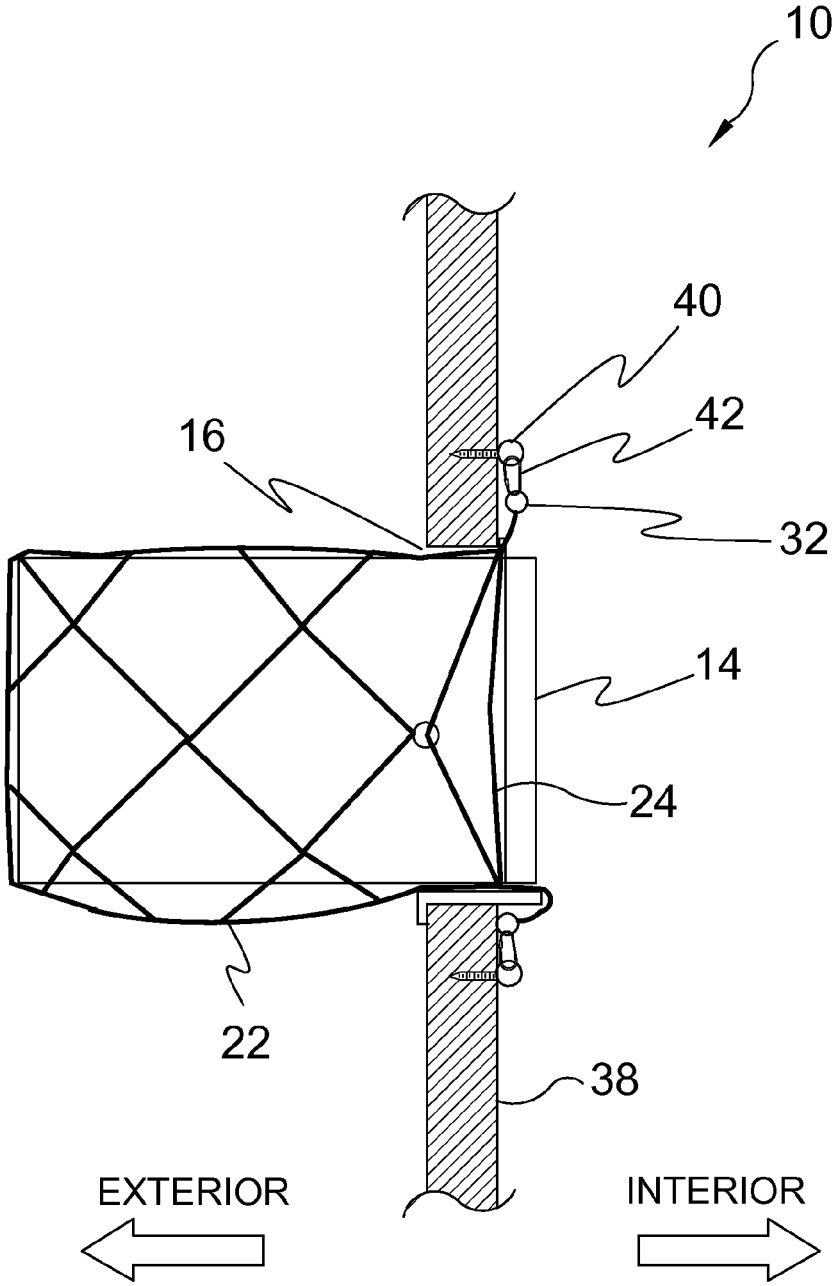
FIG. 10 is a side view of the present invention.

Referring to FIG. 10, shown is a side view of the present invention. Shown is a side view of the air conditioning unit safety net 10 mounted internally to the window 16 of a building structure 38 using an eye screw anchor device 40 with a spring clip, carabineer or other type of removable clip 42 that is attached to the mounting rings 32 disposed at the ends of the support cables 24.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A combination of a window mounted air conditioning safety net and a window air conditioning unit comprising:

a) said window air conditioning unit having a portion thereof extending out of a window in a building structure;

b) a net assembly encompassing said portion of said air conditioning unit extending out of said window to prevent said air conditioning unit from inadvertently falling during installation, operation and removal;

c) a plurality of mounting assemblies comprising anchoring devices and mounting rings for securing said net assembly to a wall surface surrounding said window within said building structure;

d) a flexible net webbing conforming to the shape and the size of said air conditioning unit;

e) said anchoring devices mounted in said wall surface inside of and surrounding said window;

f) a horizontal upper support cable and a lower support cable affixed to said net webbing, said net webbing extending between said upper and lower support cables outside of said window; and g) said mounting rings disposed on distal ends of said support cables fastened to said anchoring devices.

2. The combination according to claim 1, wherein said net webbing is affixed to said support cables with a plurality of cinching rings that are permanently attached to said net webbing and slide freely along said support cables.

3. The combination according to claim 1, wherein each of said anchoring devices having an eyelet and a removable clip that secures each of said anchoring devices to one of said mounting rings on each of said distal ends of said support cables of said net assembly.

4. The combination according to claim 1, wherein said net assembly is manufactured of a material selected from the group consisting of wire, cable and high density fiber.

5. The combination according to claim 3, wherein said removable clip is spring loaded.

6. The combination according to claim 5, wherein said spring loaded removable clip is a carabineer.

7. A flexible safety net for use with and in combination with a window of a building structure and an air conditioning unit extending partially out of said window to prevent said air conditioning unit from plummeting from said window during installation, operation and removal, comprising:

a) a flexible net webbing having a horizontal upper support cable and a horizontal lower support cable;

b) mounting rings disposed on distal ends of said upper support cable and said lower support cable;

c) adjustable means for securing said net webbing to said support cables;

d) a plurality of mounting assemblies comprising anchoring devices having eyelets embedded into a wall surface surrounding said window inside said building structure; and e) means for releasably fastening said mounting rings respectively to said anchoring devices with said net extending between said upper and lower support cables and enclosing said air conditioning unit extending out from said building structure through said window thereby preventing said air conditioning unit from falling from said window.

8. The combination of claim 7, wherein said adjustable net webbing securing means is a plurality of cinching rings permanently affixed to said net webbing and slidably mounted on said support cables.

9. The combination of claim 8, wherein said releasable mounting ring fastening means is a plurality of spring loaded removable clips.

10. The combination of claim 9, wherein said spring loaded removable clips are carabineers.

11. The combination of claim 7, wherein said net is manufactured of material selected from the group consisting of wire, cable and high density fiber.

* * * * *